US007922849B2

(12) United States Patent
Sommer et al.

(10) Patent No.: US 7,922,849 B2
(45) Date of Patent: Apr. 12, 2011

(54) PROCESS AND APPARATUS FOR MANUFACTURING SPUN-BONDED FABRIC

(75) Inventors: Sebastian Sommer, Troisdorf (DE); Wilhelm Frey, Spich (DE)

(73) Assignee: Reifenhauser GmbH & Co. KG. Maschinenfabrik, Troisdorf (DE)

( * ) Notice: Subject to any disclaimer, the term of this patent is extended or adjusted under 35 U.S.C. 154(b) by 661 days.

(21) Appl. No.: 11/430,267

(22) Filed: May 8, 2006

(65) Prior Publication Data

US 2008/0210363 A1 Sep. 4, 2008

(30) Foreign Application Priority Data

May 25, 2005 (EP) ..... 05011330
Apr. 26, 2006 (EP) ..... 06008625

(51) Int. Cl.
*D04H 3/14* (2006.01)
*D01D 5/22* (2006.01)

(52) U.S. Cl. ..... 156/167; 156/181; 264/168

(58) Field of Classification Search ..... 156/167, 156/181; 264/168
See application file for complete search history.

(56) References Cited

U.S. PATENT DOCUMENTS

| | | | | |
|---|---|---|---|---|
| 3,889,325 | A * | 6/1975 | Fleissner | 26/18.5 |
| 3,895,151 | A * | 7/1975 | Matthews et al. | 428/102 |
| 3,929,542 | A | 12/1975 | Gehrig et al. | |
| 4,940,502 | A * | 7/1990 | Marcus | 156/272.2 |
| 5,102,724 | A | 4/1992 | Okawahara et al. | |
| 5,302,220 | A | 4/1994 | Terakawa et al. | |
| 5,382,400 | A * | 1/1995 | Pike et al. | 264/168 |
| 5,701,682 | A * | 12/1997 | Chuang et al. | 34/115 |
| 5,814,349 | A | 9/1998 | Geus et al. | |
| 6,454,989 | B1 | 9/2002 | Neely et al. | |
| 6,635,136 | B2 * | 10/2003 | White et al. | 156/204 |
| 6,918,750 | B2 | 7/2005 | Geus | |
| 7,238,633 | B1 * | 7/2007 | Kaylor | 442/381 |
| 2002/0089079 | A1 | 7/2002 | Shelley et al. | |
| 2003/0064650 | A1 | 4/2003 | Van Trum et al. | |
| 2003/0161904 | A1 * | 8/2003 | Geus et al. | 425/72.2 |
| 2003/0217448 | A1 * | 11/2003 | Andersen | 28/104 |
| 2004/0041307 | A1 * | 3/2004 | Topolkaraev et al. | 264/555 |
| 2005/0087287 | A1 * | 4/2005 | Lennon et al. | 156/167 |
| 2005/0098256 | A1 | 5/2005 | Polanco et al. | |

* cited by examiner

*Primary Examiner* — Michael A Tolin
(74) *Attorney, Agent, or Firm* — Andrew Wilford

(57) ABSTRACT

Process of manufacturing spun-bonded fabric, using naturally crimped filaments, whereby the filaments are passed through a stretching unit and finally through a diffusor. The filaments are thereupon layered on a layering device, as crimped filaments. The layered filaments together with the layering device are passed through a solidifying device in which the filaments are solidified by means of a fluid.

12 Claims, 3 Drawing Sheets

PROCESS AND APPARATUS FOR MANUFACTURING SPUN-BONDED FABRIC

FIELD OF THE INVENTION

The invention relates to a process of manufacturing spun-bonded fabric, using continuous filaments and a device for implementing the process. The fact that the continuous filaments consist of thermoplastic plastic is within the scope of the invention. Continuous filaments differ from staple fibers in regards to their continuous lengths, which are shorter in length—in the range of 10 to 60 mm.

BACKGROUND OF THE INVENTION

In practice, the process of manufacturing voluminous fleece made of staple fibers is known as "high loft fleece." With this process, fleece is deposited and consolidated in separate pieces of equipment. The fleece is deposited by means of a carding machine. This type of fleece is used also in both the hygienic products industry and in filter engineering. A manufacturing experiment was conducted with comparatively thick or voluminous fleece made of continuous filaments. Therefore, naturally crimped multicomponent filaments were used. Crimping often leads to shrinkage forces that eventually tear the spun-bond fabric. As a result, the spun-bond fabric loses the required homogeneity and less acceptable products are produced.

OBJECTS OF THE INVENTION

In contrast, the object of the invention is to provide a process of manufacturing spun-bond fabric using continuous filaments, with which the disadvantageous shrinkage forces can be controlled or minimized, and thick or voluminous spun-bond fabrics can be manufactured advantageously. Furthermore, the invention is aimed at providing an appropriate apparatus.

SUMMARY OF THE INVENTION

To attain these objects, the invention provides a process of manufacturing voluminous spun-bond fabric with naturally crimped continuous filaments, wherein the filaments are passed through a stretching unit and finally through a diffusor, wherein the crimped filaments are thereupon placed on a layering unit, and wherein these crimped filaments together with the layering unit are passed through a consolidating device where the filaments are consolidated with fluid.

It is within the scope of the invention that the consolidating process is carried out with hot fluid as a thermal solidification process. Preferably, in addition to the naturally crimped filaments, non-crimped filaments are also spun and deposited on the layering unit.

According to the invention, single-layer or also multiple-layer spun-bond fabrics can be manufactured. With multiple-layer spun-bond fabrics, individual layers can be formed with naturally crimped or non-crimped filaments or with mixtures of filaments with naturally crimped and non-crimped filaments. Conveniently, the spun-bond fabric according to the invention features at least a layer that exclusively comprises naturally crimped filaments or a mixture of filaments with naturally crimped and non-crimped filaments. The spun-bond fabric according to the invention can also be manufactured as a single-layer spun-bond fabric that fully comprises naturally crimped filaments.

It is within the scope of the invention that continuous filaments are spun from a spinning head or a spinneret. After spinning, the continuous filaments are then cooled down and stretched, the cooling and stretching process particularly being carried out in a combined cooling and stretching unit. The term "stretching unit" also implies a "combined cooling and stretching unit." Before the filaments are placed on the layering unit, they are first passed through a diffusor according to the invention. The diffusor is located between the stretching unit and the layering unit or between the cooling and stretching unit and the layering unit. The diffusor is especially important within the scope of the invention. After spinning, the is continuous filaments are particularly treated according to the "Reicofil III" process (DE-PS 196 20 379/U.S. Pat. No. 5,814,349) or "Reicofil IV" process (EP-OS 1 340 843/U.S. Pat. No. 6,918,750).

Within the scope of the invention, the fact that the filaments are placed on the layering unit and then passed through the consolidating device together with said layering unit means that the mechanically relatively weak and less-durable filament batt is guided or carried by this layering unit until durable fleece is produced by means of the hot-fluid consolidating process. It is within the scope of the invention that the deposited filaments together with the layering unit are directly passed through the consolidating device, without any preconsolidation, for instance, with a calendar. Preferably, no further devices or units for mechanical and/or thermal treatment of the filament batt are connected between the filament's batt section on the layering unit and the consolidating device. The filament batt is thereby further transported only with the layering unit between its batt section and the consolidating device.

Thermal solidification with hot fluid within the scope of the process according to the invention especially means solidification with the help of gaseous hot fluid, particularly the thermal solidification with the help of hot air. In the process, the hot fluid conveniently flows transversely or perpendicularly to the surface of the batt on to the filament batt. The filament batt is pressurized with the hot fluid conveniently over the surface in the consolidating device. Thus, this preferred pressurization of the filament batt with focussed air flow according to the invention differs, particularly, when a hot air knife is used. It is within the scope of the invention that the temperature of the hot fluid for thermal solidification at least lies above the lowest softening point of all filament raw materials in the filament batt. The filament batt can be stabilized effectively in this manner. It is furthermore within the framework of the invention that the filament batt or the spun-bond fabric is internally exposed to the flow of the hot fluid.

Naturally crimped filaments within the framework of the invention particularly mean filaments that exhibit radii of curvature below 5 mm after being deposited, in a relaxed state, on the layering unit. The filaments feature corresponding crimping over the greatest part of their length, with the above mentioned radii of curvature. This crimped state must be directly detectable on the filaments, especially after stretching and layering the filaments, i.e. also without further mechanical or thermal influence on the filaments. According to a very preferred embodiment of the invention, the filaments with natural crimping have multicomponent filaments and preferably multicomponent filaments with side/side alignment and/or with eccentric core/jacket alignment. In case different raw materials are put below one another in such a filament, they will be subjected to corresponding cooling and stretching effects during the spinning process. After layering the filaments under the final filament velocity, both raw materials exhibit different residual stresses. At the end of layering the filaments below and after the air-pressure that stretches the filament no longer prevails, different relaxation and retardation processes (shrinkage) occur in different raw materials; as a result of this the filaments crimp. The radius of curvature and the number of crimps per filament length depend on the raw materials, cross-section of the filaments and process conditions. The filaments particularly crimp prior to being deposited in the air stream and particularly inside the diffusor. The fact that filaments are deposited as crimped filaments, on a layering unit, particularly means that at least a part of the naturally crimped filaments already crimp prior to being deposited and thus particularly after the stretching unit or inside the diffusor. These filaments can still also crimp between the diffusor and the layering unit. The fact that filaments are deposited, as crimped filaments, on a layering unit does not rule out the possibility that naturally crimped filaments can still crimp whilst on the layering unit. Also the filaments can exhibit a tendency to further crimping or additional crimping during subsequent thermal solidification. Crimping can be part of thermal solidification according to the invention.

Within the framework of the invention, non-crimped filaments mean filaments with radii of curvature greater than 5 mm, which are at the same time flat and lie on the layering unit. According to a particularly preferred embodiment of the invention, non-crimped filaments are mono-component filaments and/or multicomponent filaments with symmetrical core/jacket alignment. It is within the scope of the invention that mono-component filaments consist of homogeneous solid filaments.

According to a specially preferred embodiment, the filament batt or spun-bond fabric at least comprises a layer made of a mixture of filaments with natural crimping and non-crimped filaments. Thereby, this filament mixture is preferably spun from a single spinning head and finally preferably cooled and stretched together.

The filament batt on the layering unit can therefore consist of at least a layer of non-crimped filaments and at least a layer applied to the latter filaments with natural crimp. The two or more spinning heads are conveniently arranged successively. An alternative to this is to produce at least one of the above mentioned layers in advance, which can then particularly run on a roller.

It is within the scope of the invention that the filament batt or the placed layer of a spun-bond fabric exhibits more than 20-weight percent, preferably more than 30-weight percent and preferably more than 40-weight percent filaments with natural crimping. It is furthermore within the framework of the invention that the rest of the filaments of this filament batt or this layer consist of non-crimped filaments.

It is recommendable that spun filaments are first passed through a cooling device and then through a stretching unit or a combined cooling and stretching unit, thereupon through the diffusor and finally deposited on the layering unit. In the cooling device or in the combined cooling and stretching unit, normally air supply or suction of cold air takes place. On or in the diffusor or between the diffusor and the stretching unit at least an ambient air inlet slit is provided. According to a very preferred embodiment of the invention, the aggregate made of cooling device, stretching unit or combined cooling and stretching unit and diffusor, besides the air supply in the cooling device or in the combined cooling and stretching unit and besides the air inlet via at least an ambient air inlet slit is designed as a closed system. Otherwise no air is supplied or essentially no air is supplied into the aggregate. The closed system has particularly proven itself within the framework of the process according to the invention and for the solution of the technical problem according to the invention.

It has already been mentioned above that the diffusor is very essential for the solution of the technical problem according to the invention. With the help of the diffusor connected down-stream of the stretching unit, effective crimping of the naturally crimped filaments can be achieved prior to the layering process in combination with the other features according to the invention. Thick or voluminous spun-bond fabric can be manufactured advantageously in this manner.

According to the invention, the filament batt or the spun-bond fabric together with the layering unit is led though the consolidating device. In other words, the spun-bond fabric together with the layering unit is transported to the consolidating device or through the consolidating device. The layering device thereby features at least a layering unit. It is within the scope of the invention that the layering unit comprises a conveyor unit or a conveyor belt for filament batts. According to a particularly preferred embodiment of the process based on the invention, a layering unit is used, which at least comprises a layering unit in the form of a gas-permeable (air permeable) belt screen. This kind of belt screen especially involves a continuous belt that is guided over turn-around rollers. The application of a belt screen as a layering unit or the application of belt screen s in the layering unit has been well established.

It is within the scope of the invention that the spun-bond fabric in the consolidating device is pressurized with hot fluids such that the spun-bond fabric is pressed against the layering unit, especially against a gas-permeable belt screen of the layering unit. As already explained above, the spun-bonded fabric surface is transversely pressurized conveniently by the hot fluid forces. Through this, the spun-bond fabric is effectively pressed on the layering unit or on the belt screen, through which undesired displacements and shrinkage openings can be avoided in the spun-bond fabric. It is within the scope of the invention that the hot fluid flows through the spun-bond fabric and the gas-permeable belt screen. During thermal solidification on the layering unit, the spun-bond fabric is pressurized with the hot fluid successively from opposite directions with regard to its top and bottom sides.

According to a preferred embodiment of the invention, the layering unit comprises a single layering unit, especially in the form of a gas-permeable belt screen and the spun-bond fabric is conveyed on to this single layering unit (belt screen) by the consolidating device. That is, according to this embodiment, the filament batt (spun-bond fabric) is conveyed directly to the single layering unit (belt screen) and without connecting further plant or layering components. The spun-bond fabric is thereby conveniently pressed on the layering unit or on the belt screen through the transverse pressurization by the fluid. With this embodiment, the spun-bond fabric lies on the top side of the layering unit or of the belt screen and the pressurization with the hot fluid occurs conveniently from the top. The term "belt screen" normally means a conventional belt screen, which is usually utilized in spun-bond fabric production as a layering unit. With the term "belt screen", one basically means any gas-permeable conveyor device, with which the filament batt or the spun-bond fabric can be transported and through which the hot fluid can flow.

Another preferred embodiment of the invention is characterized in that the layering unit comprising a first layering unit, particularly in the form of a belt screen on which the spun filaments are deposited and that the spun-bond fabric (filament batt) with this first layering unit is transported to a second layering unit, particularly in the form of a belt screen, and transported with this second layering unit through the consolidating device. According to a very preferred embodiment of the invention, the second layering unit thereby conveys the spun-bond fabric with a reduced transport velocity relative to the first layering unit. According to an embodiment of the invention, the first and second layering unit follow each other directly, without a further layering unit or conveyor device being connected in the middle. With this embodiment the spun-bond fabric is directly transferred from the first layering unit to the second layering unit. According to another embodiment of the invention, a third layering unit, particularly in the form of a belt screen can be connected between the first and the second layering unit, this latter unit can likewise convey the spun-bond fabric. According to an embodiment variant, the spun-bond fabric is transported on the lower side of this third layering unit, especially on the bottom side of a third belt screen. In this manner, the spun-bond fabric is conveniently held by means of suction air on the underside of the third layering unit. With this embodiment within the scope of the invention, the transport velocity of the spun-bond fabric reduces from the first layering unit to the third layering unit and then reduces further from the third layering unit to the second layering unit.

An embodiment of the invention is characterized in that the filaments on the top side of a first layering unit are deposited and then transported together with this first layering unit to a second layering unit. The filament batt is then transferred from the first layering unit directly to the second layering unit and then transported on the bottom side of the second layering unit through the consolidating device. Also with this embodiment of the invention, the first layering unit and the second layering unit preferentially consist of belt screen s. The transport velocity of the second layering unit is conveniently lower than the transport velocity of the first layering unit.

A further embodiment of the invention is characterized in that the filaments are deposited on the first layering unit, preferably on the first belt screen and subsequently between the first layering unit and a second layering unit that is preferably formed as the second belt screen are transported through the consolidating device. The spun-bond fabric is conveniently held here between a lower belt screen and a top belt screen during thermal solidification.

It is within the scope of the invention that the thermally hardened, spun-bond fabric in the consolidating device is finally subjected to final solidification. This final solidification particularly involves water jet solidification of the spun-bond fabric.

Object of the invention is furthermore an apparatus for manufacturing a voluminous spun-bond fabric, wherein at least a spinning device for creating filaments with natural crimping is provided for, wherein furthermore a layering unit for layering the filaments with natural crimping is available and wherein a consolidating device for consolidating the filament batt (spun-bond fabric) with the provision that an arrangement of the filament batt (spun-bond fabric) is such that it may be passed together with the layering unit directly through the consolidating device. According to a preferred embodiment of the invention also non-crimped filaments may be produced with the apparatus.

Within the scope of the invention, the fact that the filament batt together with the layering unit may be passed directly through the consolidating device means, particularly, that between the batt section of the filaments and the consolidating device no further consolidating apparatus exists, in particularly no calender. A preferred embodiment of the apparatus according to the invention is characterized in that between the spinning device and the layering unit a cooling and stretching unit for the filaments is provided. Between the stretching unit and the layering unit a diffusor for filaments is furthermore provided.

The invention is based on the insight that voluminous or thick spun-bond fabric s can be manufactured with the process and the apparatus according to the invention, which are is characterized by excellent quality and homogenous properties. These manufactured, voluminous, spun-bond fabric s according to the invention can be compared with established "high-loft non-woven fabrics" made of staple fibers as regards their thickness. What is of special importance within the scope of the invention is that spun-bond fabric s can be manufactured from continuous fibers, which exhibit no uncontrolled inhomogeneity caused by shrinkage forces or opening or holes. Effective control of the shrinkage forces can be achieved with the processing method according to the invention. The voluminous filament batt particularly achieved with the help of crimped filaments can be effectively fixed through direct thermal consolidating with the hot fluid and thus by retaining or even increasing the thickness of the spun-bond fabric. The invention is thus far based on the insight that the filament batt on the layering unit, with which it is directly driven into the thermal consolidating device is effectively supported and guided and that with the direct thermal solidification, fixation of the filament batt can take place without the filament batt being opened or destroyed by the internal shrinkage forces.

BRIEF DESCRIPTION OF THE DRAWING

In the following the invention is described in detail on the basis of an illustrative drawing of an embodiment. Therein.

SPECIFIC DESCRIPTION

Figure 8:
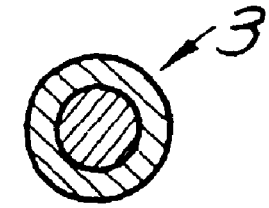
FIG. 8 is a section through a bicomponent filament according to the invention.
Figure 9:
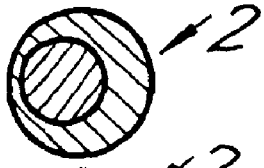
FIG. 9 is a view like FIG. 8 of a further embodiment.
Figure 10:
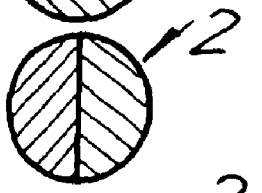
FIG. 10 is a view like FIG. 8 of an additional implementation embodiment.
Figure 11:
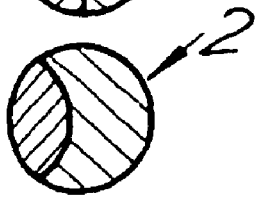
FIG. 11 is a view like FIG. 8 of a further embodiment.

FIGS. 1 to 7 show an apparatus for carrying out the process of manufacturing a voluminous spun-bond fabric 1 made of continuous filaments 2, 3 according to the invention. Filaments 2 are spun with naturally crimped and non-crimped filaments 3 and deposited on a layering unit 4. The naturally crimped filaments 2 may involve filaments 2 with eccentric core/jacket arrangement (FIG. 9) or filaments 2 with side/side arrangement (FIGS. 10 and 11). In FIG. 10 a bicomponent filament 2 with symmetrical side/side arrangement and in FIG. 11 a bicomponent filament 2 with asymmetrical side/side arrangement is shown. Mono-component filaments (not shown) can be used as non-crimped filaments 3 or multicomponent filaments or bicomponent filaments 3 with symmetrical core/jacket arrangement (FIG. 8).

The one or several spun filaments 2, 3 from a spinneret are conveniently first transported for cooling through a cooling device and finally transported for stretching the filaments 2, 3 through a stretching unit. A diffusor 5 with diverging diffusor walls is connected to the stretching unit according to the invention as schematically shown in FIGS. 1 to 7. At the end of the diffusor 5, the filaments 2, 3 are deposited on the layering unit 4. This layering unit 4 conveys the filaments 2, 3 directly to a consolidating device 6 in which the filaments 2, 3 are consolidated with hot fluid, preferably hot air. In FIGS. 1 to 7 it is evident that the filaments 2, 3 together with the layering unit 4 are directly transported to the thermal hot-fluid solidification process without connection of intermediate consolidating devices. In FIGS. 1 to 7 the manner of pressurization with hot air inside the consolidating device 6 has been illustrated by means of arrows. These arrows show that the hot air preferably impinges perpendicularly on the surface of the layering unit 4 and perpendicularly or essentially perpendicularly on the surface of the spun-bond fabric 1. As a result of this pressurization with the hot air the spun-bond fabric 1 becomes pressed against the layering unit 4. In FIG. 1 to 7 a further arrow is visible below the diffusor 5. This arrow shows that under the layering unit 4, below the diffusor 5 or below the batt section of the filaments 2, 3, air is sucked through the gas-permeable layering unit 4 in order to ensure that the filaments 2, 3 are deposited safely in the usual manner.

Figure 1:
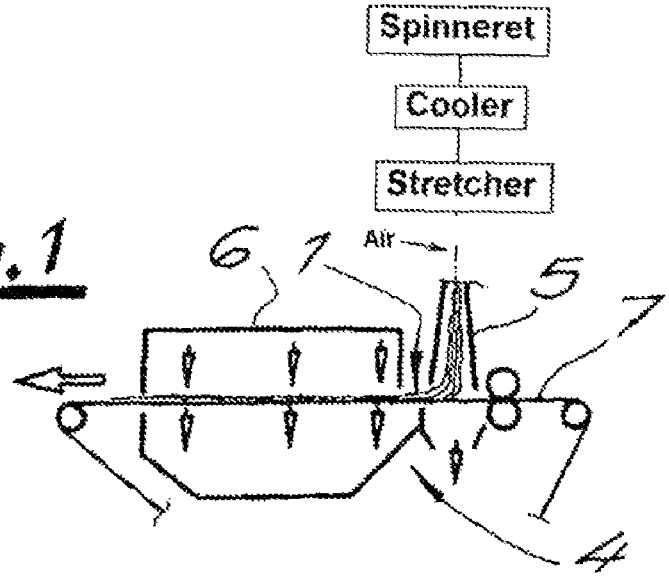
FIG. 1 is a side schematic view of a first embodiment of an apparatus according to the invention.

FIG. 1 shows a first embodiment of an apparatus according to the invention, where the layering unit 4 comprises a single layering unit in the form of a belt screen 7. The filaments 2, 3 deposited below the diffusor 5 on the top side of this belt screen 7 are conveyed directly into the consolidating device 6 and there the filament batt or the spun-bond fabric 1 is thermally consolidated with hot air in that position. Since the previously "loose" filament batt is pressed against the belt screen 7 with the help of pneumatic forces, undesired displacements or shrinkage openings can be avoided effectively in the spun-bond fabric.

Figure 2:
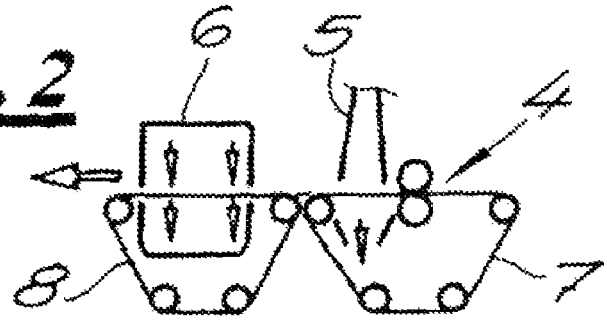
FIG. 2 is a view like FIG. 1 of a second embodiment.

In the embodiment according to FIG. 2 the layering unit 4 comprises a first layering unit in the form of a first belt screen 7 onto which the spun filaments 2, 3 are deposited. With this first belt screen 7 the spun-bond fabric 1 is conveyed to a second layering unit in the form of a second belt screen 8 and together with this second belt screen 8 the spun-bond fabric 1 is transported through the consolidating device 6. The spun-bond fabric 1 is transported on the top side of the two belt screens 7, 8 and from the first belt screen 7 it is directly transferred to the second belt screen 8 without further layering units in between. According to the particularly preferred embodiment of the invention, the transport velocity of the second belt screen 8 is reduced relative to the transport velocity of the first belt screen 7. Also through the velocity reduction from the first belt screen 7 to the second belt screen 8 an undesired shrinkage tendency in the filament batt can be compensated out effectively.

Figure 3:
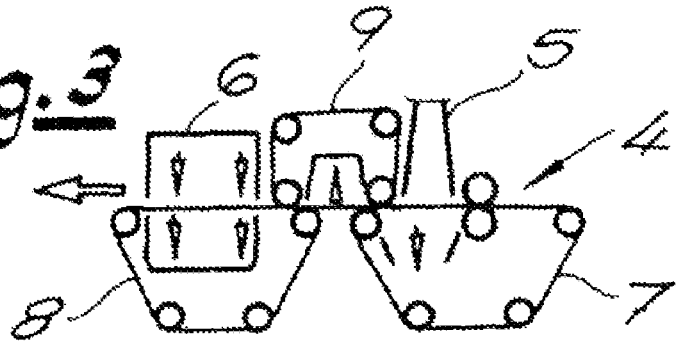
FIG. 3 is a view like FIG. 1 of a third embodiment.

With the embodiment shown in FIG. 3, the layering unit 4 comprises a first layering unit in the form of a first belt screen 7, a second layering unit in form of a second belt screen 8 and a third layering unit in form of a third belt screen 9. The filaments 2, 3 are first deposited on the first belt screen 7 and then in FIG. 3 they are transported to the third belt screen 9 toward the left as shown by the arrow. The filament batt lying on the top side of the first belt screen 7 is transferred on the lower side of the third belt screen 9. In doing so, the filament batt is held on the lower side of the third belt screen 9 by means of air suction. This air suction on the third belt screen 9 is indicated in FIG. 3 by means of an arrow. From the underside of the third belt screen 9 the filament batt is then transferred to the top side of the second belt screen 8. In FIG. 3 it is evident that the underside of the third belt screen 9 overlaps the top side of the first belt screen 7 and the second belt screen 8. The filament batt laid on the top side of the second belt screen 8 is then conveyed together with the second belt screen 8 through the consolidating device 6. According to a particularly preferred embodiment of the invention, the transport velocity is decreased from the first belt screen 7 to the third belt screen 9 and from the third belt screen 9 to the second belt screen 8. In other words, in the embodiment of FIG. 3, the first belt screen 7 runs at the highest transport velocity, the third belt screen 9 with the second highest transport velocity and the second belt screen 8 with the lowest transport velocity.

Figure 4:
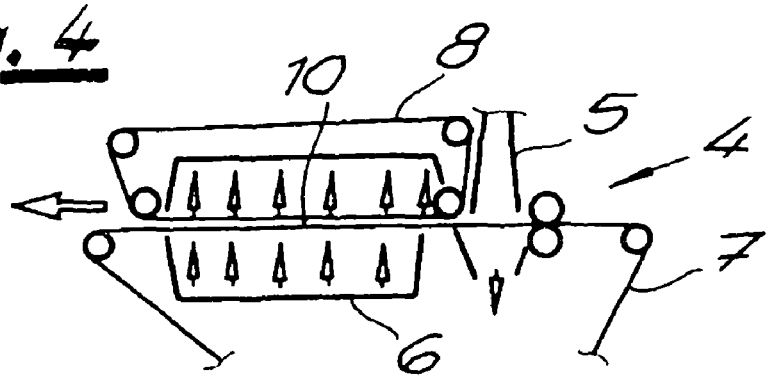
FIG. 4 is a view like FIG. 1 of a fourth embodiment.

Also in the embodiment according to FIG. 4 the filaments 2, 3 are deposited on the first belt screen 7 and first transported on the top side of this belt screen 7 toward the left toward the consolidating device 6. Finally, the filament batt is conveyed into a gap 10 defined by the lower first belt screen 7 and a top second belt screen 8. The filament batt is transported through the consolidating device 6 in the gap 10. Through the pneumatic forces in the consolidating device 6, the filament batt is lifted up off the top side of the first belt screen 7 and pressed onto the underside of the second belt screen 8 and at the same time is further transported from the second belt screen 8 toward the left.

Figure 5:
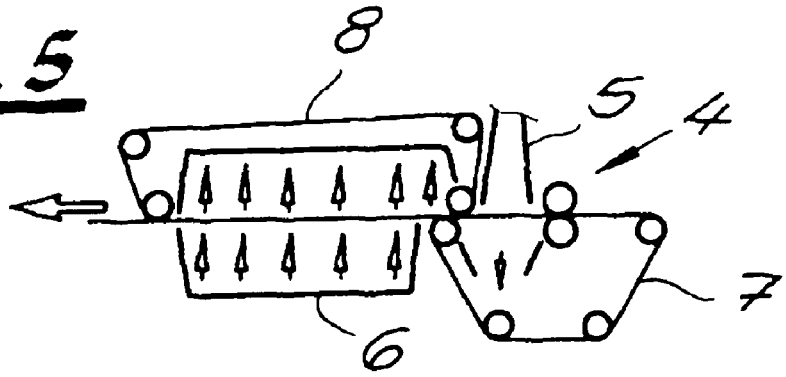
FIG. 5 is a view like FIG. 1 of a fifth embodiment.

In the embodiment according to FIG. 5, the filaments 2, 3 on the top side of the first belt screen 7 are deposited and transported toward the left toward the consolidating device 6. Upstream of the consolidating device 6, the filament batt comes in contact with a top second belt screen 8 and is transferred from the first belt screen 7 to the underside of the second belt screen 8 and transported on the underside of the second belt screen 8 through the consolidating device 6. The filament batt is thereby held by means of pneumatic forces in the consolidating device 6 on the underside of the second belt screen 8. The transport velocity of the second belt screen 8 is reduced also just like in the embodiment according to FIG. 4, here preferably relative to the transport velocity of the first belt screen 7.

Figure 6:
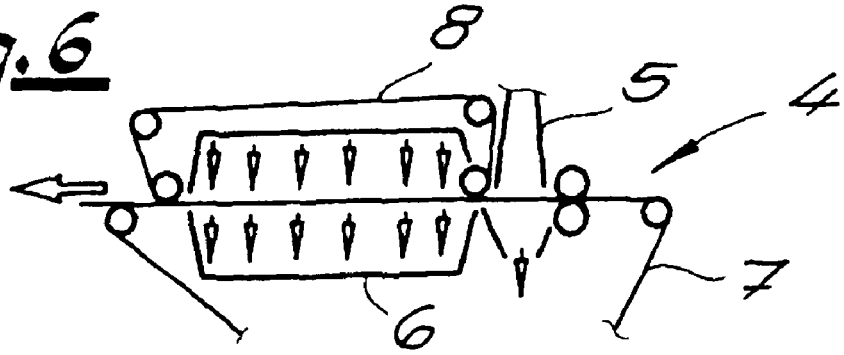
FIG. 6 is a view like FIG. 1 of a sixth embodiment.

A further embodiment variant of the apparatus according to the invention is shown in FIG. 6. The filaments 2, 3 just aw with the other apparatus variants are deposited on the top side of the first belt screen 7 and transported toward the left toward the consolidating device 6. In the area of the consolidating device 6 a second top belt screen 8 is provided. The first lower belt screen 7 forms a gap with the second top belt screen 8 and the spun-bond fabric 1 is transported in this gap through the consolidating device 6, the spun-bond fabric in the case of this embodiment variant lying both on the top side of the first belt screen 7 as well as on the underside of the second belt screen 8. The spun-bond fabric is thus simultaneously clamped between the belt screens 7, 8.

Figure 7:
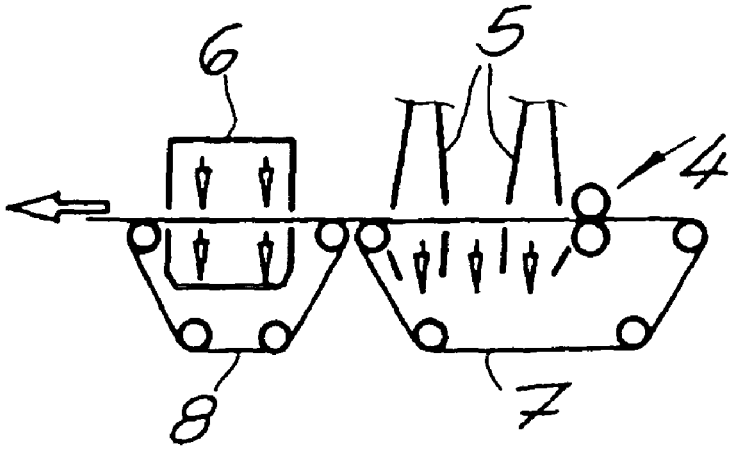
FIG. 7 is a view like FIG. 1 a seventh embodiment.

FIG. 7 shows a variant of an apparatus for facilitating a two-layer spun-bond fabric 1. Two spinning heads (not shown) are provided here, with which the filaments 2, 3 are spun, then deposited as successively arranged batt sections on the top side of the first belt screen 7. The two filament batts are then transferred directly from the first belt screen 7 to a second belt screen 8 and further transported on the top side of this second belt screen 8 and conveyed to the consolidating device 6. In FIG. 7 it is evident that the suction range not only exists under the two diffusors 5, but also between the batt sections or between the diffusors 5 underneath the first belt screen 7. Through this interconnected suction area, undesired displacements or shrinkage openings in the first filament batt can be prevented until the second filament batt is deposited.

The invention claimed is:

1. A method of making voluminous spun-bond fabric, the method comprising the steps of:

spinning a multiplicity of extruded and continuous filaments having natural crimp and passing them downward through a closed system comprised of a cooler, a stretcher, and a diffuser and depositing them as a batt while still crimped on a gas-permeable belt screen;

cooling the filaments with air in the cooler;

stretching the filaments in the stretcher;

admitting air to the diffuser or between the stretcher and the diffuser through an air inlet while excluding the entry of outside air to the closed system except for the air used for cooling in the cooler and air admitted to the diffuser or through the inlet;

activating natural crimp of at least some of the naturally crimped filaments in the diffuser;

displacing the filaments on the belt screen directly after being deposited and without any preconsolidation into a consolidating device; and in the consolidating device projecting a hot fluid perpendicularly against the batt to press the batt against the belt screen and thermally consolidate the filaments of the batt.

2. The method defined in claim 1 wherein the naturally crimped filaments are multicomponent filaments with side/side arrangement or with eccentric core/jacket arrangement.

3. The method defined in claim 1 wherein non-crimped filaments are spun onto the belt screen in addition to the naturally crimped filaments.

4. The method defined in claim 3 wherein the non-crimped filaments are monocomponent filaments or multicomponent filaments with symmetric core/jacket arrangement.

5. The method defined in claim 1, further comprising the step of:

depositing with the naturally crimped filaments a layer of non-crimped filaments.

6. The method defined in claim 5 wherein the batt has more than 20% by weight of naturally crimped filaments.

7. The method defined in claim 1 wherein the belt screen comprises a first belt screen onto which the spun filaments are deposited and a second belt screen that transports the filaments through the consolidating device.

8. The method defined in claim 7 wherein the spun-bond fabric spun-bond is deposited onto the top side of the first belt screen and is transported through the consolidating device on the underside of the second belt screen.

9. The method defined in claim 7, further comprising the step of:

advancing the second belt screen at a lower speed than the first belt screen.

10. The method defined in claim 9 wherein the second belt screen is above the batt, the method further comprising the step of:

aspirating air through the second belt screen and thereby holding the batt against a lower side of the second belt screen in the consolidating device.

11. The method defined in claim 9, further comprising the step of:

providing a third screen above the second screen and compressing the batt vertically between the second and third screens in the consolidating device.

12. The method defined in claim 9 wherein both the first and second belt screens are underneath the batt, the method further comprising the step of:

providing a third belt screen between the first and second belt screens and above the batt; and advancing the third belt screen at a speed slower than that of the first belt screen and greater than that of the third belt screen.

* * * * *